US007789917B2

(12) United States Patent
Iu et al.

(10) Patent No.: US 7,789,917 B2
(45) Date of Patent: Sep. 7, 2010

(54) AMPHOTERIC STILBENE COMPOSITION

(75) Inventors: Kai Kong Iu, San Diego, CA (US); Gary Larson, San Diego, CA (US); Hai Q Tran, San Diego, CA (US); William A Houle, Encinitas, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 12/186,079

(22) Filed: Aug. 5, 2008

(65) Prior Publication Data

US 2008/0290320 A1 Nov. 27, 2008

Related U.S. Application Data

(62) Division of application No. 11/117,823, filed on Apr. 29, 2005, now abandoned.

(51) Int. Cl.
*D06L 3/12* (2006.01)

(52) U.S. Cl. ..... 8/648; 8/919; 8/602; 428/195.1; 428/211.1; 428/32.1; 428/32.21

(58) Field of Classification Search ..... 8/648, 8/919, 602, 631; 428/608, 32.1, 32.21, 195.1, 428/211.1

See application file for complete search history.

(56) References Cited

U.S. PATENT DOCUMENTS

| | | | | |
|---|---|---|---|---|
| 3,157,644 | A | 11/1964 | Franz et al. | |
| 3,575,866 | A | 4/1971 | Strobel et al. | |
| 3,779,931 | A | 12/1973 | Fries et al. | |
| 3,909,266 | A * | 9/1975 | Inoue et al. | 430/335 |
| 5,873,913 | A | 2/1999 | Cowman et al. | |
| 6,066,673 | A * | 5/2000 | McIver et al. | 514/634 |
| 6,180,584 | B1 * | 1/2001 | Sawan et al. | 510/382 |
| 6,258,370 | B1 * | 7/2001 | Behrends et al. | 424/405 |
| 2003/0013628 | A1 | 1/2003 | Farrar et al. | |
| 2003/0147925 | A1 * | 8/2003 | Sawan et al. | 424/400 |
| 2006/0051385 | A1 * | 3/2006 | Scholz | 424/405 |

FOREIGN PATENT DOCUMENTS

| | | | |
|---|---|---|---|
| EP | 0291214 | A | 11/1988 |
| EP | 1300514 | A | 4/2003 |
| EP | 1378545 | A | 1/2004 |
| EP | 1426193 | A | 6/2004 |
| WO | WO 01/46161 | A | 6/2001 |

* cited by examiner

*Primary Examiner*—Lorna M Douyon
*Assistant Examiner*—Amina Khan

(57) ABSTRACT

A brightening system includes a substrate and an amphoteric stilbene composition established on the substrate. The amphoteric stilbene composition includes a predetermined amount of at least one of 4,4'-diamino-2,2'-stilbene disulfonic acid, biarylsulfonate-4,4'-diamino-2,2'-stilbene disulfonic acid, biaryldisulfonate-4,4'-diamino-2,2'-stilbene disulfonic acid, derivatives thereof, salts thereof, and mixtures thereof; and a fixing agent.

12 Claims, 2 Drawing Sheets

AMPHOTERIC STILBENE COMPOSITION

CROSS REFERENCE TO RELATED APPLICATIONS

This application is a divisional of U.S. patent application Ser. No. 11/117,823, filed Apr. 29, 2005, entitled "Amphoteric Stilbene Composition," now abandoned, which application is incorporated by reference herein in its entirety.

BACKGROUND

The present disclosure relates generally to stilbene compositions, and more particularly to amphoteric stilbene compositions.

Traditional brighteners, for example, those used in paper pulp, are generally anionic. Yet in some instances, anionic brighteners may have a tendency to separate or coagulate from solution once a fixing agent is mixed therein. Traditional fixing agents are cationic in nature, for example, poly cationic polymers. The anionic brighteners have a tendency to react and combine with these types of fixing agents, and the resulting product may separate or coagulate from the solution mix. As a result, the brightness of the paper may decrease. Further, the manufacturing of such anionic brightener solutions may include extra steps so as to physically separate the anionic brightener from the fixing agent so that instability of the brightener is substantially avoided. However, these extra steps may be costly and time consuming.

As such, it would be desirable to provide a brightener that is compatible with a fixing agent.

SUMMARY

An amphoteric stilbene composition is disclosed. The composition includes a fixing agent mixed with a predetermined amount of at least one of 4,4'-diamino-2,2'-stilbene disulfonic acid, biarylsulfonate-4,4'-diamino-2,2'-stilbene disulfonic acid, biaryldisulfonate-4,4'-diamino-2,2'-stilbene disulfonic acid, derivatives thereof, salts thereof, and/or mixtures thereof.

BRIEF DESCRIPTION OF THE DRAWINGS

Objects, features and advantages will become apparent by reference to the following detailed description and drawings, in which like reference numerals correspond to similar, though not necessarily identical components. For the sake of brevity, reference numerals having a previously described function may not necessarily be described in connection with subsequent drawings in which they appear.

DETAILED DESCRIPTION

Embodiment(s) of the amphoteric stilbene composition mix an amphoteric stilbene with a fixing agent. The amphoteric stilbene is compatible with the fixing agent and as such, is advantageously prevented from separating from the solution. This compatibility allows the solution to be manufactured without having to separate the brightener from the fixing agent. Further, the amphoteric stilbene substantially enhances fluorescence efficiency and remains solubilized in a wide pH range.

Figure 1:
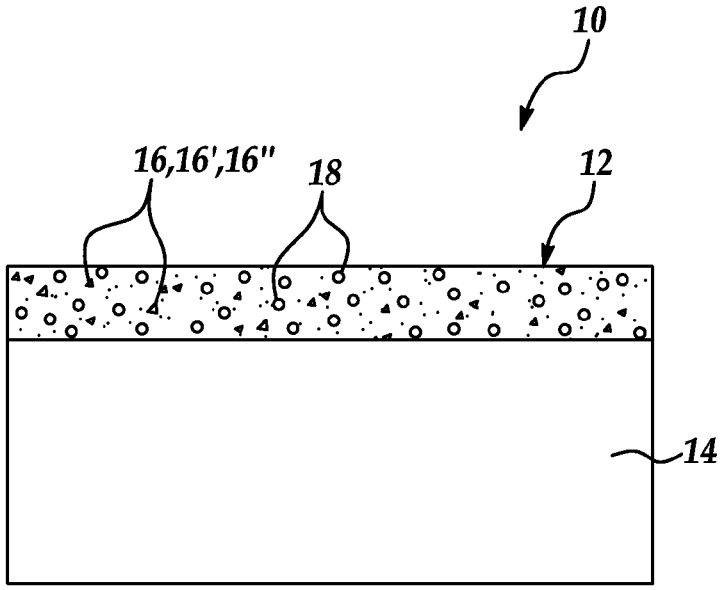
FIG. 1 is a schematic view of a substrate having an embodiment of the amphoteric stilbene composition established thereon.

Referring now to FIG. 1, an embodiment of the system 10 includes a substrate 14 having an embodiment of the amphoteric stilbene composition 12 established thereon. In one embodiment of the system 10, the amphoteric stilbene composition 12 is established/dispersed/disposed/printed on a substrate. Establishing, dispersing, disposing, or printing on the substrate 14 may be incorporated in the paper making process (for example, at the size press or wet end). Non-limitative examples of accomplishing the establishing/dispersing/disposing/printing include firing the solution from an ink jet pen; dip coating; and/or draw coating, and/or combinations thereof.

Suitable substrates 14 include, but are not limited to papers, polymeric materials, metals, and/or combinations thereof. It is to be understood that any of the substrates 14 may be porous and/or non-porous materials.

The amphoteric stilbene composition 12 includes a predetermined amount of at least one of 4,4'-diamino-2,2'-stilbene disulfonic acid 16, biarylsulfonate-4,4'-diamino-2,2'-stilbene disulfonic acid, biaryldisulfonate-4,4'-diamino-2,2'-stilbene disulfonic acid, derivative(s) thereof, salts thereof, or mixtures thereof.

Figure 2A:
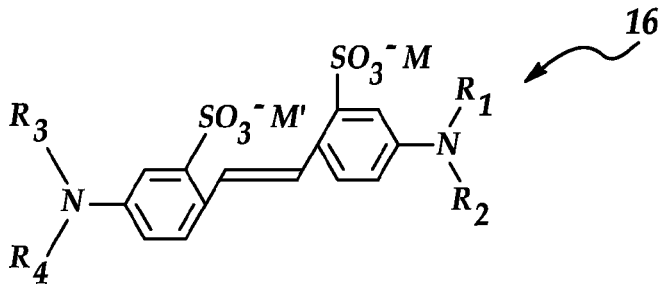
FIG. 2A is a generic structure of 4,4'-diamino-2,2'-stilbene disulfonic acid.
Figure 2B:
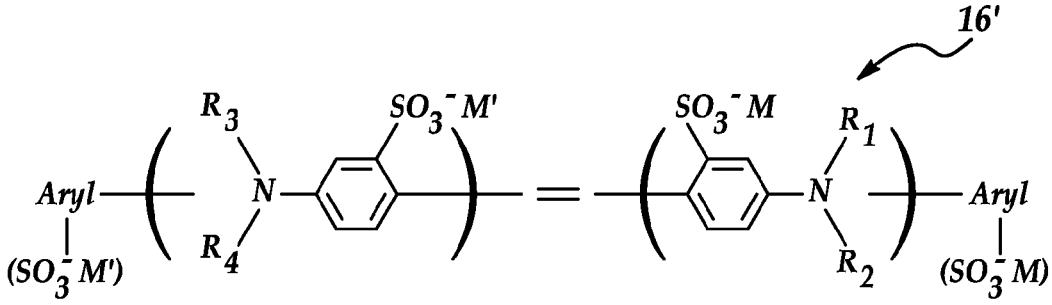
FIG. 2B is a generic structure of biarylsulfonate-4,4'-diamino-2,2'-stilbene disulfonic acid.
Figure 2C:
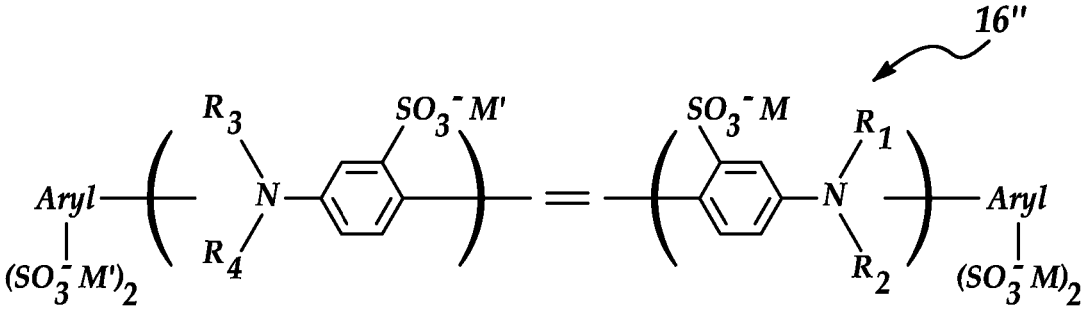
FIG. 2C is a generic structure of biaryldisulfonate-4,4'-diamino-2,2'-stilbene disulfonic acid.

FIG. 2A depicts the parent structure of 4,4'-diamino-2,2'-stilbene disulfonic acid 16; FIG. 2B depicts the parent structure of biarylsulfonate-4,4'-diamino-2,2'-stilbene disulfonic acid 16'; and FIG. 2C depicts the parent structure of biaryldisulfonate-4,4'-diamino-2,2'-stilbene disulfonic acid 16". It is to be understood that M and M' may be the same or different. In an embodiment, M and M' are $H^+$, $Na^+$, $K^+$, and/or $NR_4^+$ (where R is H, alkyl groups, or aryl groups). $R_1$, $R_2$, $R_3$, and $R_4$ may also be the same of different, and in an embodiment are H, alkyl groups, aryl groups, or heterocyclic rings.

Non-limitative examples of amphoteric stilbene derivatives of 4,4'-diamino-2,2'-stilbene disulfonic acid 16 include those that are commercially available under the names Fluorescent Brightener 24, Fluorescent Brightener 28, Fluorescent Brightener 71, Fluorescent Brightener 85, Fluorescent Brightener 210, and Fluorescent Brightener 220 from a variety of suppliers. It is to be understood that these brighteners have the parent molecular structure of 4,4'-diamino-2,2'-stilbenedisulfonic acid 16.

Non-limitative examples of salts of 4,4'-diamino-2,2'-stilbene disulfonic acid 16, biarylsulfonate-4,4'-diamino-2,2'-stilbene disulfonic acid 16', and biaryldisulfonate-4,4'-diamino-2,2'-stilbene disulfonic acid 16", respectively, include all organic and inorganic salts thereof. In an embodiment, the salts include any of the parent structures as shown in FIGS. 2A, 2B, and 2C, with $Na^+$ or $K^+$ for M and M'.

In an embodiment, the at least one of 4,4'-diamino-2,2'-stilbene disulfonic acid 16, biarylsulfonate-4,4'-diamino-2,2'-stilbene disulfonic acid 16', biaryldisulfonate-4,4'-diamino-2,2'-stilbene disulfonic acid 16", derivatives thereof, and/or salts thereof is present in the composition 12 in an amount ranging between about 0.1 grams per square meter (gsm) and about 5 gsm. In a non-limitative example, 0.98 μmoles/L of 4,4'-diamino-2,2'-stilbene disulfonic acid 16 is present in the composition 12.

The amphoteric stilbene composition 12 also includes a fixing agent 18 that is compatible with the at least one of 4,4'-diamino-2,2'-stilbene disulfonic acid 16, biarylsulfonate-4,4'-diamino-2,2'-stilbene disulfonic acid 16', biaryldisulfonate-4,4'-diamino-2,2'-stilbene disulfonic acid 16", derivatives thereof, salts thereof, and/or mixtures thereof. In an embodiment, highly reactive cationic polymers are included in the fixing agent 18 in order to fix the anionic colorants in the printed image. Non-limitative examples of such cationic polymers include polyguanidines and polyethyleneimines. In an example embodiment, the cationic polymers are polymonoguanidines, such as, for example, poly ($C_{3-18}$-hydrocarbyl monoguanidines). The poly($C_{3-18}$-hydrocarbyl monoguanidines) include Formula 1 and Formula 2 (depicted below) or salts thereof:

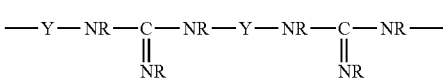

Formula (1)

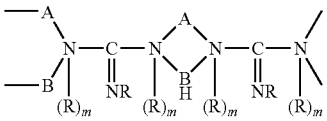

Formula (2)

In Formulas 1 and 2, "m" is zero or one, "Y" is a $C_{2-18}$-hydrocarbyl group, "A" and "B" are hydrocarbyl groups which together include a total of 3 to 18 carbon atoms, and each "R" is a hydrogen, alkyl, alkoxy, substituted alkyl or substituted alkoxy.

In another embodiment, the poly($C_{3-18}$-hydrocarbyl monoguanidine) is Formula 3 (depicted below), or salts thereof. In Formula 3, "n" ranges between 2 and 50.

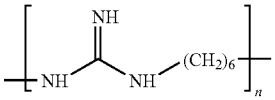

Formula (3)

In addition to the polyguanidines and the polymonoguanidines, other non-limitative examples of fixing agent(s) 18 include guanidines, biguanidines, diguanidines, polyalkylbiguanides, polyalkylimines, polyarylimines, polyalkylguanidines, polyarylguanidines, and mixtures thereof.

Non-limitative examples of guanidines, diguanidines, and polyguanidines include adamantylguanidine; adipyldiguanidine; aminoguanidine; benzimidazoleguanidine; butylguanidine; benzylguanidine; cyclohexylguanidine; diisopropylguanidine; dibutylguanidine; dibenzylguanidine; diphenylguanidine; dicyandiamide (cyanoguanidine); ditolylguanidine; dinaphthylguanidine; dicyclohexylguanidine; dinorbornylguanidine; diadamantylguanidine; dimethylguanidine; diethylguanidine; ethylenediguanidine; ethylguanidine; guanidine; glutaryldiguanidine; hexamethylenediguanidine; heptamethylenediguanidine; isopropylguanidine; methylguanidine; malonyldiguanidine; naphthylguanidine; norbornylguanidine; nitroaminoguanidine; octamethylenediguanidine; oxalyldiguanidine; pentamethylenediguanidine; phenylenediguanidine; piperazinediguanidine; propylenediguanidine; phthalyldiguanidine; pimelyldiguanidine; phenylguanidine; succinyldiguanidine; suberyldiguanidine; tetramethylenediguanidine; tolylguanidine; and combinations thereof.

Further, non-limitative examples of biguanides (imidodicarbonimidic diamides), biguanidines, imidotricarbonimidic diamides, imidotetracarbonimidic diamides, dibiguanides, bis(biguanidines), polybiguanides, and poly(biguanidines) include adipyldibiguanide; adamantylbiguanide; butylbiguanide; benzylbiguanide; biguanide; biguanidine; cyclohexylbiguanide; dimethylbiguanide; diethylbiguanide; diisopropylbiguanide; dibutylbiguanide; dibenzylbiguanide; diphenylbiguanide; ditolylbiguanide; dinaphthylbiguanide; dicyclohexylbiguanide; dinorbornylbiguanide; diadamantylbiguanide; ethylenedibiguanide; ethylbiguanide; glutaryldibiguanide; hexamethylenedibiguanide; heptamethylenedibiguanide; isopropylbiguanide; malonyldibiguanide; methylbiguanide; norbornylbiguanide; naphthylbiguanide; octamethylenedibiguanide; oxalyldibiguanide; phenylbiguanide; pimelyldibiguanide; phthalyldibiguanide; paludrine; polyhexamethylene biguanide; pentamethylenedibiguanide; piperazinedibiguanide; phenylenedibiguanide; propylenedibiguanide; succinyldibiguanide; suberyldibiguanide; tetramethylenedibiguanide; tolylbiguanide; and combinations thereof.

In a non-limitative example embodiment, the fixing agent 18 is poly(hexamethylenebiguanide) hydrochloride (PHMB). It is to be understood that the fixing agent 18 may be present in any desirable amount, and in an embodiment, the amount ranges between about 0.1 gsm and about 10 gsm. In a non-limitative example, 97 μeq/L, 16 μM (assuming 6 equivalents per mole) of the fixing agent 18 is used.

Without being bound to any theory, it is believed that the mixing of a biguanidine type fixing agent 18 with the amphoteric stilbene 16, 16', 16" advantageously enhances fluorescence due, at least in part, to formation of structural rigidity that restricts twisting about the C=C bond.

In an embodiment of the method, the amphoteric stilbene 16, 16', 16" and the fixing agent 18 may be substantially homogeneously and/or heterogeneously mixed together. Further, the amphoteric stilbene composition 12 may be established on the substrate 14 via any suitable method, such as those previously described.

To further illustrate embodiment(s) of the present disclosure, the following examples are given. It is to be understood that these examples are provided for illustrative purposes and are not to be construed as limiting the scope of the disclosed embodiment(s).

EXAMPLES

To understand the nature of the 4,4'-diamino-2,2'-stilbenedisulfonic acid, solution phase fluorescence of stilbene, stilbene 4,4'-diaminostilbene dihydrochloride, and 4,4'-diamino-2,2'-stilbenedisulfonic acid were studied at pH 4, 7 and 10 in the presence and absence of a fixing agent.

Table 1 lists the compositions of the solutions presented to the spectrofluorimeter.

TABLE 1

| Solution Compositions | | | |
|---|---|---|---|
| Stilbene Derivative Identity & Concentration | IPA Co-Solvent | Buffer Types & Concentrations | Fixing Agent Concentration |
| Stilbene (0.84 μmoles/L) | 0.015 vol. % | pH 4 = 40 mM succinic acid/succinate | 97 μeq/L, 16 μM* 0 μeq/L |
| | | pH 7 = 40 mM $H_2PO_4/HPO_4$ | 97 μeq/L, 16 μM* 0 μeq/L |
| | | pH 10 = 40 mM $HCO_3/CO_3$ | 97 μeq/L, 16 μM* 0 μeq/L |
| 4,4'-diaminostilbene dihydrochloride (0.84 μmoles/L) | 0.048 vol. % | pH 4 = 40 mM succinic acid/succinate | 97 μeq/L, 16 μM* 0 μeq/L |
| | | pH 7 = 40 mM $H_2PO_4/HPO_4$ | 97 μeq/L, 16 μM* 0 μeq/L |
| | | pH 10 = 40 mM $HCO_3/CO_3$ | 97 μeq/L, 16 μM* 0 μeq/L |
| 4,4'-diaminostilbene-2,2'-stilbenedisulfonic acid (0.98 μmoles/L) | 0.000 vol. % | pH 4 = 40 mM succinic acid/succinate | 97 μeq/L, 16 μM* 0 μeq/L |
| | | pH 7 = 40 mM $H_2PO_4/HPO_4$ | 97 μeq/L, 16 μM* 0 μeq/L |
| | | pH 10 = 40 mM $HCO_3/CO_3$ | 97 μeq/L, 16 μM* 0 μeq/L |

*Molar concentration assumes 6 equivalents/mole

A 53 g/L working solution of fixing agent was prepared by dissolving VANTOCIL IB in water. VANTOCIL IB is a guanidine-based salt that can be used as a PHMB fixing agent as discussed in the U.S. patent application Ser. No. 11/103,827 filed on Apr. 11, 2005, now U.S. Pub. No. 2006/0228499 which application is incorporated herein by reference. VANTOCIL IB is commercially available from Avecia Ltd. located in Manchester, UK. Assuming the fixing agent has a repeat unit of $\{(CH_2)_3NH(C{=}NH)NH(C{=}NH)NH(CH_2)_3.HCl\}m$-, the equivalent weight of the fixing agent is 219 g/eq, and the normality of the working solution was 0.242 eq/L. When 10 μL of the working solution was spiked into 25 mL of the prepared stilbene solutions, the resulting fixing agent content was 97 μeq/L (or 16 μM: assuming 6 eq/mole).

Buffers at pH 4, 7, and 10 were made by dissolving 0.01 moles of succinic acid (pH 4) or monobasic sodium phosphate (pH 7) or sodium bicarbonate (pH 10) into about 80 mL of water, adjusting to the appropriate pH by addition of sodium hydroxide against a calibrated pH electrode (calibrated at pH 4, 7, 10) and finally diluting to 100 mL with water. When 10 mL of buffer was added to 15 mL of stilbene working solutions, the final buffer concentration was 40 millimolar.

Table 2 illustrates the preparation of concentrates for the stilbene solutions. The stilbene concentrate was diluted into neat IPA and the 4,4'-diaminostilbene dihydrochloride was dissolved in 50/50 v/v IPA. The mM concentrations were calculated for the concentrates based on the masses and the labeled purity.

TABLE 2

| Stilbene Concentrates | | | | | |
|---|---|---|---|---|---|
| Stilbene Type | Reagent Purity | mg | volume | ML IPA co-solvent | mM |
| Stilbene | 96% | 27.7 | 26.5 | 26.5 | 5.575 |
| 4,4'-diaminostilbene dihydrochloride | 95% | 26.1 | 100 | 50 | 0.876 |
| 4,4'-diaminostilbene-2,2'-stilbenedisulfonic acid | 85% | 35.5 | 1000 | 0 | 0.081 |

Aliquots of the concentrates (shown in Table 2) were diluted to one liter with water to produce the stilbene working solutions (shown in Table 3).

TABLE 3

| Working Solutions | | | | |
|---|---|---|---|---|
| Stilbene Type | mL concentrate | Total dilution volume, mL | mg/L | μM |
| Stilbene | 0.25 | 1000 | 0.262 | 1.39 |
| 4,4'-diaminostilbene dihydrochloride | 1.6 | 1000 | 0.418 | 1.40 |
| 4,4'-diaminostilbene-2,2'-stilbenedisulfonic acid | 20 | 1000 | 0.710 | 1.63 |

The analyte solutions were made by mixing 15 ml of the stilbene working solutions with 10 mL of the appropriate buffer. This produced the nine analyte solutions at pH 4, 7, and 10 without any fixing agent. A second set of nine solutions was prepared in an identical manner, except 10 μL of the fixing agent spike solution was added to produce the analyte solutions.

TABLE 4

| Analyte Solutions | | | |
|---|---|---|---|
| Stilbene Type | mL Stock | mL Buffer | μM Analyte |
| Stilbene | 15 | 10 | 0.836 |
| 4,4'-diaminostilbene dihydrochloride | 15 | 10 | 0.841 |
| 4,4'-diaminostilbene-2,2'-stilbenedisulfonic acid | 15 | 10 | 0.978 |

A JY Spex model FL212 dual grating fluorescence spectrophotometer was used for all measurements.

Initially the excitation and emission spectra were measured in each of the pH buffers to determine the excitation and emission maxima for the system. No fixing agent was added. The excitation and emission maxima for the stilbenes are compiled below, in Table 5, as a function of pH.

TABLE 5

| Stilbene Type | pH 4 Excitation | pH 4 Emission | pH 7 Excitation | pH 7 Emission | pH 10 Excitation | pH 10 Emission |
|---|---|---|---|---|---|---|
| Stilbene | 296 | 353 | 295 | 353 | 300 | 353 |
| 4,4'-diaminostilbene dihydrochloride | 307 | 455 | 309 | 428 | 309 | 427 |
| 4,4'-diamino-2,2'-stilbene disulfonic acid | 327 | 467 | 328 | 445 | 327 | 445 |

Due, in part, to the protonation of the amino function, the two amino stilbene derivatives demonstrated a shift in peak emission wavelength of about 20-30 nm at pH 4. However, this shift in emission wavelength was not observed for stilbene. The excitation maxima were independent of pH.

Figure 3:
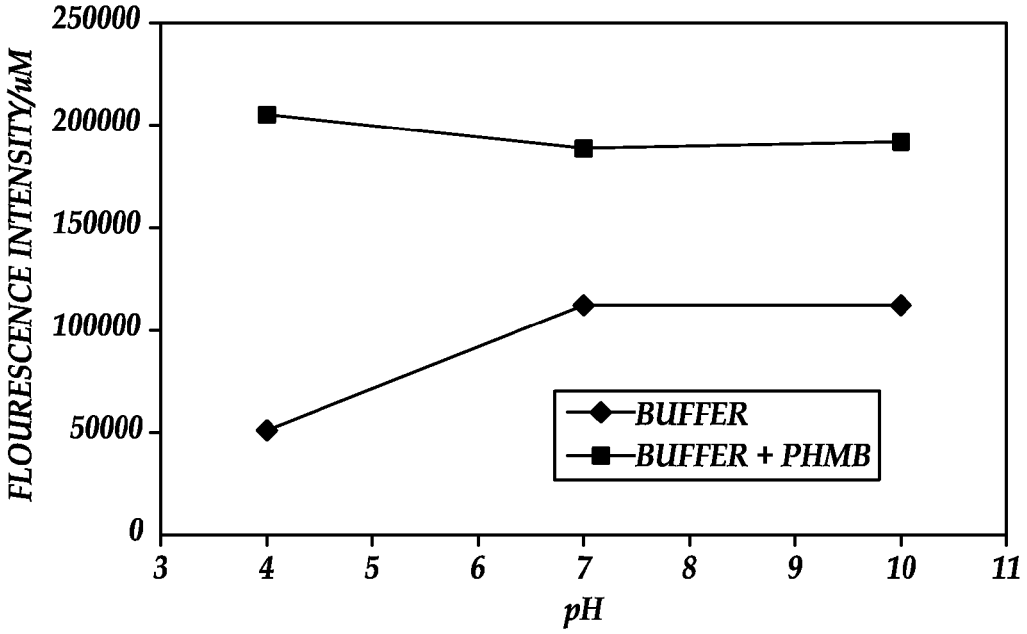
FIG. 3 is a graph depicting the fluorescence intensity over pH range of 4,4'-diamino-2,2'-stilbene disulfonic acid and a buffer, both with and without a fixing agent.

Once the peak maxima were identified, the effects of fixing agent and pH were studied. FIG. 3 shows the fluorescence emission intensities for the 4,4'-diamino-2,2'-stilbene disulfonic acid as a function of pH in the presence and absence of fixing agent. For these results and the subsequent emission spectra, the emission intensity was normalized to 1 μM. When present, the fixing agent content was 97 times the stilbene derivative content (on an equivalent not molar basis). Buffer concentrations were 40 mM.

As depicted in the chart in FIG. 3, in the absence of the fixing agent (buffer plot), the protonation of the amino function dramatically decreased the fluorescence. However, in the presence of the fixing agent at pH 7 and pH 10, the fluorescence intensity of the disulfonate derivative increased to about 80% of the un-sulfonated diaminostilbene. Further, the presence of the fixing agent offset the effect of low pH on the fluorescence intensity. It is believed that the effect of the fixing agent may be due, at least in part, to the interaction with the diaminostilbene disulfonate. If the cationic fixing agent wraps around the stilbene derivative and interacts simultaneously with the two sulfonate functions, the stilbene derivative may become a more rigid structure. Rigidity is known to increase fluorescence intensity. Alternatively, the fixing agent may interfere with exchange reactions at the sulfonate site that would otherwise reduce fluorescence.

Table 6 illustrates the normalized peak fluorescence intensity in arbitrary unit/μM for the stilbene solutions with and without fixing agent at different pH.

TABLE 6

| | Stilbene | | 4,4'-diaminostilbene dihydrochloride | | 4,4'-diamino-2,2'-stilbenedisulfonic acid | |
|---|---|---|---|---|---|---|
| | w/o fixing agent | w/ fixing agent | w/o fixing agent | w/ fixing agent | w/o fixing agent | w/ fixing agent |
| pH 4 | 75k | 90k | 75k | 80k | 50k | 205k |
| pH 7 | 65k | 65k | 275k | 285k | 115k | 190k |
| pH 10 | 65k | 55k | 265k | 280k | 115k | 190k |

The stilbene showed scattered results in the range of 90 k to 55 k. This may be due, in part, to instrument measurement error and impurity. However, the inert aromatic structure of stilbene should not have any interaction with pH nor with the fixing agent.

The 4,4'-diaminostilbene dihydrochloride showed substantially no difference in fluorescence intensity with and without the fixing agent. This may be due, at least in part, to the non-interactive nature of two equally charged species, i.e. positive to positive. However, the noted increase in fluorescence intensity at high pH (7 and 10) may be due to the deprotonation of the amino groups. At high pH, the deprotonation of the amino groups of the 4,4'-diaminostilbene dihydrochloride would decrease the solubility of this material due to the loss of the charge that is essential for dissolution in water.

Without fixing agent, the behavior of the 4,4'-diamino-2,2'-stilbenedisulfonic acid is similar to the diamino stilbene: it shows pH dependent fluorescence in the acidic pH range. However, the pH dependency of the fluorescence disappears once the fixing agent is added into the solution. The fluorescence intensity went up about 4 fold at pH 4 and about 2 fold at pH 7 and pH 10. Regarding the solubility in water, 4,4'-diamino-2,2'-stilbenedisulfonic acid is associated with charge at both acidic and basic pHs. This is an advantage over the diamino stilbene that will have no charge at basic pH, potentially resulting in solubility decrease.

Embodiment(s) of the composition 12, system 10, and method as defined herein include the following advantages. The stilbene amphoteric composition 12 substantially enhances the fluorescence of the substrate 14. Without being bound to any theory, it is believed that this enhanced fluorescence may be a result of, in part, the amphoteric stilbene 16 and fixing agent 18 complex reducing the twisting about the C═C bond.

While several embodiments have been described in detail, it will be apparent to those skilled in the art that the disclosed embodiments may be modified. Therefore, the foregoing description is to be considered exemplary rather than limiting.

What is claimed is:

1. A paper substrate having enhanced fluorescence, comprising:

the paper substrate; and an amphoteric stilbene composition printed on the paper substrate, the amphoteric stilbene composition including:

a predetermined amount of 4,4'-diamino-2,2'-stilbene disulfonic acid; and a fixing agent selected from poly(hexamethylenebiguanide) hydrochloride (PHMB);

wherein the amphoteric stilbene composition exhibits a fluorescence intensity per μM ranging from about 190,000 to about 205,000 at a pH ranging from 10 to 4.

2. The paper substrate as defined in claim 1 wherein the predetermined amount of the 4,4'-diamino-2,2'-stilbene disulfonic acid ranges from about 0.1 gsm to about 5 gsm.

3. The paper substrate as defined in claim 1 wherein the fixing agent is present in an amount ranging from about 0.1 gsm to about 10 gsm.

4. The paper substrate as defined in claim 1 wherein the 4,4'-diamino-2,2'-stilbene disulfonic acid is adapted to enhance the fluorescence of the paper substrate on which the composition is printed.

5. The paper substrate as defined in claim 1 wherein the 4,4'-diamino-2,2'-stilbene disulfonic acid is at least one of substantially homogeneously and heterogeneously mixed with the fixing agent.

6. A method of making a paper substrate having enhanced fluorescence, the method comprising:

mixing a predetermined amount of 4,4'-diamino-2,2'-stilbene disulfonic acid with a fixing agent to form a solution, the fixing agent selected from poly(hexamethylenebiguanide) hydrochloride (PHMB); and printing the solution on the paper substrate;

wherein the solution substantially enhances the fluorescence of the paper substrate.

7. The method as defined in claim 6 wherein the fluorescence of the paper substrate is substantially enhanced at a pH ranging between about 2 and about 13.

8. The method as defined in claim 6 wherein the fluorescence of the paper substrate is substantially enhanced at one of pH 4, pH 7, and pH 10.

9. The method as defined in claim 6 wherein printing the solution is accomplished by firing via an ink jet device.

10. The method as defined in claim 6 wherein the 4,4'-diamino-2,2'-stilbene disulfonic acid is at least one of substantially homogeneously and heterogeneously mixed with the fixing agent.

11. The method as defined in claim 6 wherein the predetermined amount of the 4,4'-diamino-2,2'-stilbene disulfonic acid ranges from about 0.1 gsm to about 5 gsm.

12. The method as defined in claim 6 wherein the fixing agent is present in an amount ranging from about 0.1 gsm to about 10 gsm.

* * * * *